United States Patent [19]

Dinsmore et al.

[11] Patent Number: 4,794,354

[45] Date of Patent: Dec. 27, 1988

[54] APPARATUS AND METHOD FOR MODIFYING MICROWAVE

[75] Inventors: Bruce E. Dinsmore, Glendale; Gary O. Larson, Phoenix; William H. Brettner, Glendale, all of Ariz.

[73] Assignee: Honeywell Incorporated, Minneapolis, Mich.

[21] Appl. No.: 100,958

[22] Filed: Sep. 25, 1987

[51] Int. Cl.[4] ..... H01P 1/205; H01P 7/06

[52] U.S. Cl. ..... 333/207; 333/202; 333/226; 333/235

[58] Field of Search ..... 333/202, 206–207, 333/209, 212, 222–224, 231, 232, 235, 263, 208

[56] References Cited

U.S. PATENT DOCUMENTS

| | | | |
|---|---|---|---|
| 2,566,050 | 8/1951 | Wolf | 333/232 X |
| 2,749,523 | 6/1956 | Dishal | 333/207 |
| 3,537,041 | 10/1970 | Kommrusch | 333/207 R |
| 3,618,135 | 11/1971 | Weller | 333/232 |
| 3,737,816 | 6/1973 | Honicke | 333/209 X |

*Primary Examiner*—Marvin L. Nussbaum

*Attorney, Agent, or Firm*—William W. Holloway; Joseph S. Failla

[57] ABSTRACT

The microwave frequency characteristics of a cavity having a center conducting element and conducting cavity are modified by changing the length of the center conducting element. The resonating structure is comprised of a coaxial member providing the principal resonating surfaces. One end of the coaxial member is coupled to a wall of the cavity surrounding the center conducting member with provision for access to the interior of the center conducting member from a position exterior to the cavity. The second end of the center conducting element is free. In addition, the second end of the resonating element has threads fabricated on an interior surface and a self-locking insert positioned in the threaded portion. A threaded rod is inserted through the self-locking insert and extends beyond the center conducting element into the cavity. The threaded rod has a structure on the end remaining inside the center conducting element that permits a tuning instrument, inserted from a position exterior to the cavity, to rotate the threaded rod against the force of the self-locking insert and, consequently vary the length of the rod extending beyond the cylindrical member.

13 Claims, 3 Drawing Sheets

APPARATUS AND METHOD FOR MODIFYING MICROWAVE

This invention was made with the support of the U.S. Government which has certain rights therein.

BACKGROUND OF THE INVENTION

1. Field of the Invention

This invention relates generally to microwave circuits and, more particularly, to apparatus and method for modifying frequency characteristics of resonant cavities. Although the present invention is discussed with reference to band-pass filters, the technique has application to oscillators, delay lines, filters, etc. operating in the microwave frequency region.

2. Description of the Related Art

In the implementation of microwave circuits, a component in which the resonant frequency characteristics can be conveniently altered is frequently required. For example, the output circuit of the aircraft Traffic Alert and Collision Avoidance System II (TCAS II) differential phase shift keying (DPSK) and pulse modulated transmitter, a band-pass filter in the 1030 MHz region capable of high power operation is required. This filtering is required to reduce the off-channel DPSK spectral components to an acceptable level. In addition, the filter must be a low loss component within the filter pass band because of the expense in generating power in this frequency range.

In the related art, such requirements can be met by the pass band filter illustrated in FIG. 1 and FIG. 2. FIG. 1 shows a perspective view of the resonant cavity with the cover removed, while FIG. 2 shows a cross sectional view of the resonant cavity structure. The resonant cavity 9 is fabricated in a housing 15. Passing through the cavity 9 is the center conductor element 10. The center conductor element 10 passes through the cavity 9 and is positioned in aperture 15A and aperture 15B of the housing 15. The portion of the center conductor element 10 in aperture 15A is held in place by a set screw 18 and finally soldered in the aperture 15A for mechanical and electrical coupling to the housing 15. The portion of the center conductor element extending into aperture 15B has an insulating (i.e., typically teflon) cover thereon. The insulating cover 11 prevents the center conducting resonant element 10 from contacting the housing 15. The aperture 15 is threaded and has a conducting tuning element 21 and locking element 22 inserted therein. The position of the tuning element 21 adjusts the distance 1 between the tuning element 21 and the center conductor element 10. The activating signals are applied to the device by coaxial cable 13. Coaxial cable 13 has center conductor element 13A, a shielding conductor 13B and a dielectric material 13C therebetween. The coaxial cable 13 has a coupling element 13D that is adapted to connect to coupling element 17 attached to the housing 15. The coupling element 17 has a conductor 14 associated therewith that couples the center conductor 13A of coaxial cable 13 with the center conductor element 10. Aperture 16 in the wall of the cavity permits a radiation coupling between adjacent cavities.

The operation of the tunable resonant cavity of the related art shown in FIG. 1 and FIG. 2 can be understood in the following manner. A microwave frequency signal is introduced into the cavity 9 and applied to the center conductor element 10. The signal applied to the center conductor element 10 will typically have a distributed spectral composition. The geometry of the cavity 9, the geometry of the center conductor element 10 and their interrelationship will result in a defined resonant frequency. This resonant frequency will be the dominant frequency of the signal generated by the center conductor element 10. The spacing between the end of the center conductor element 10 in aperture 15B and the tuning element 21 forms a capacitive coupling to the housing 15. By varying the distance between the center conductor element 10 and the tuning element 21 designated by 1 in FIG. 2, the capacitive coupling to the housing 15 can be controlled, consequently controlling the capacitive loading on center conductor element 10. The capacitive loading, in turn, controls the resonant frequency of the resonant structure. The distance between the end of the center conductor element 10 and the tuning element 21 is accomplished by loosening locking element 22, rotating tuning element 21 until the appropriate resonant frequency is obtained and tightening the locking element. The locking element is secured against the tuning member to prevent unwanted changes in the position of the tuning element. However, the forcing of the locking element 22 against the tuning element 21 can result in sufficient movement of the tuning element to provide an unacceptable change in the resonant frequency. Typically, the procedure involves iterative steps until the resonant structure has the desired resonant frequency. In addition, the tuning procedure is relatively complex, requiring loosening of the locking element, positioning of the tuning element and tightening of the locking element. In addition, electric fields can be strong upon application of power to the cavity and these fields can produce voltage breakdown. Finally, the fabrication of the device can be difficult, requiring close tolerances for the fabrication of aperture 15A and aperture 15B, while requiring soldering operation that involves the housing 15.

A need has therefore been felt for apparatus and method that can modify or tune the frequency characteristics of a microwave component, that can be easily fabricated and that can be conveniently adjusted.

FEATURES OF THE INVENTION

It is an object of the present invention to provide an improved technique for modifying frequency characteristics of microwave circuits.

It is a feature of the present invention to provide improved apparatus and method for modifying the frequency characteristics of a microwave resonant cavity.

It is a more particular feature of the present invention to provide an improved band pass filter.

It is another more particular object of the present invention to provide an improved method for adjusting the cavity resonant frequency by adjustment of the center conductor member.

It is still another particular object of the present invention to provide a resonant cavity device with the capability of transmitting increased power therethrough.

It is yet another feature of the present invention to provide a mechanism for tuning the resonant frequency of cavity that is locked in position upon completion of the tuning adjustment.

SUMMARY OF THE INVENTION

The aforementioned and other features are accomplished, according to the present invention, by providing a resonant cavity device with a center conductor element extending into the cavity. The center conductor element is coupled to the cavity housing at a first end while a second end of the center conductor element is free. The center conductor element is hollow and is threaded on the interior in the region of the second end. Inserted in the threaded region is a self locking device with a threaded rod inserted therethrough. The center conductor element is attached to the cavity housing in such a manner as to provide access to the threaded rod from the exterior of the resonant cavity device. By rotating the threaded end, the length of the center conductor element, and consequently the structure resonant frequency, can be tuned. The locking insert minimizes slippage or jumping during a tuning operation and locks the threaded rod in place after the tuning operation.

These and other features of the present invention will be understood upon reading of the following description along with the drawings.

DESCRIPTION OF THE PREFERRED EMBODIMENT

1. Detailed Description of the Figures

Figure 1:
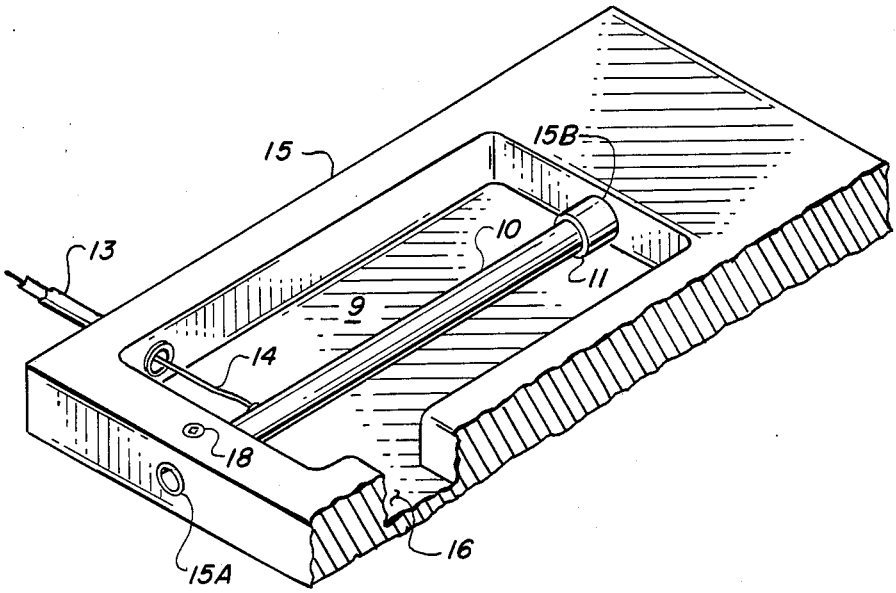
FIG. 1 is a perspective view of a tunable resonant microwave cavity according to the related art.
Figure 2:
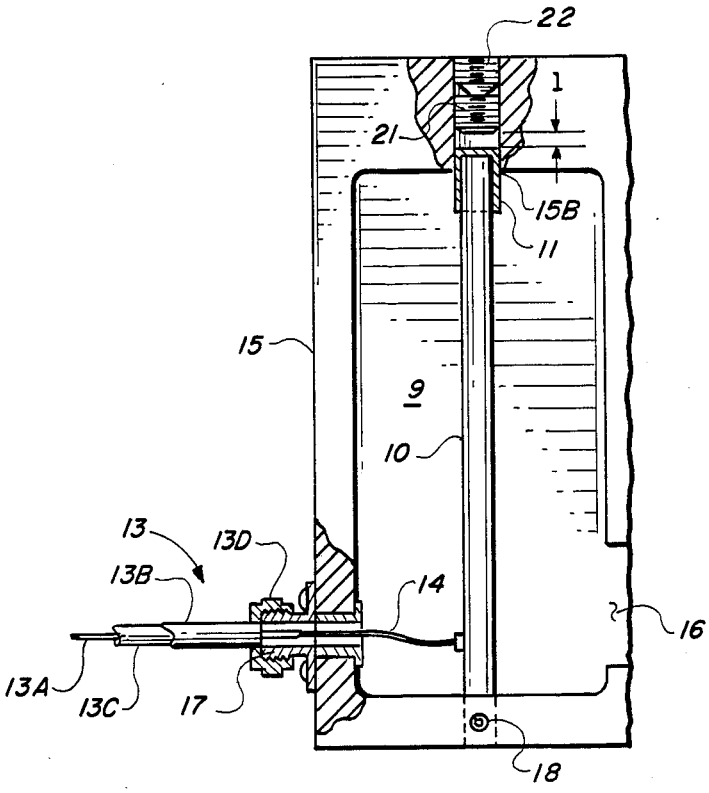
FIG. 2 is a cross sectional view of the related art tunable resonant microwave cavity of FIG. 1.

FIG. 1 and FIG. 2 have been described with reference to the related art.

Figure 3:
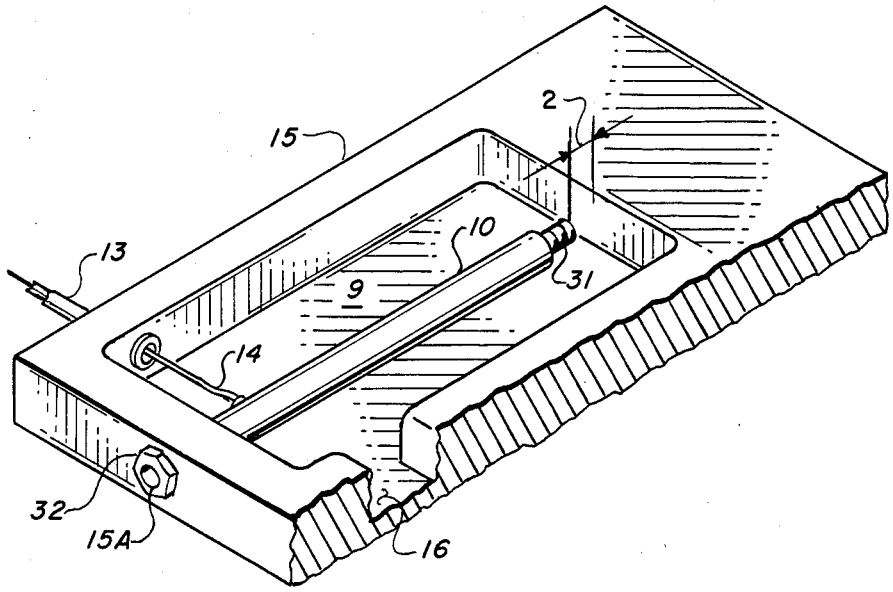
FIG. 3 is a perspective view of a tunable resonant cavity according to the present invention.
Figure 4:
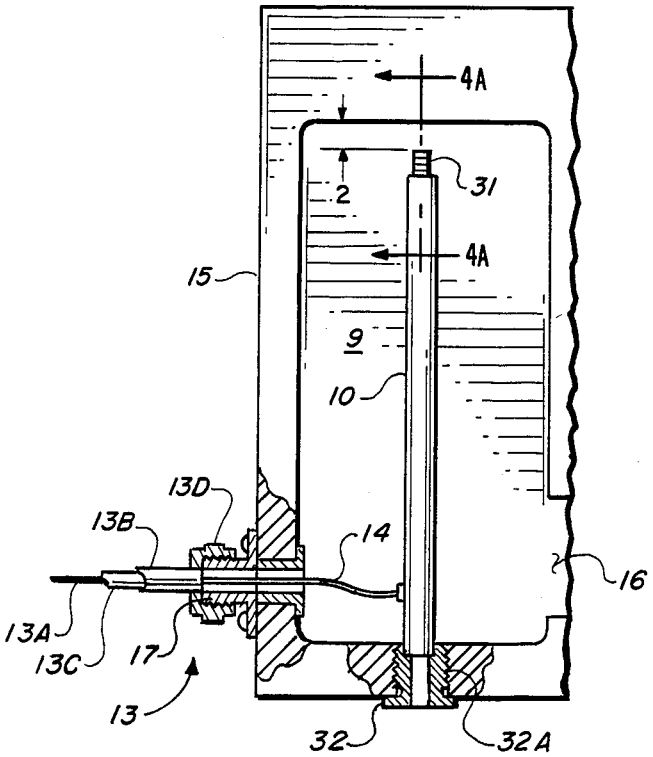
FIGS. 4 and 4A are cross sectional views of a tunable resonant cavity according to the present invention.
Figure 4A:
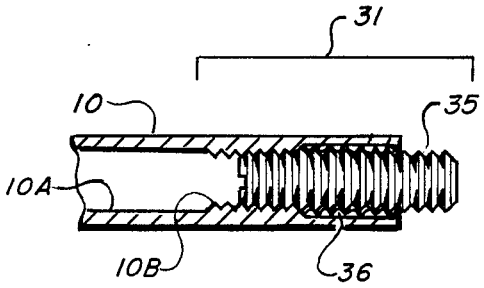

Referring next to FIG. 3 and FIG. 4, a perspective view of the resonant cavity structure of the present invention and a cross section view of the resonant cavity structure of the present invention are shown, respectively. The housing 15 has a cavity 9 fabricated therein. A coaxial cable 13 (having a center conductor 13A, a shielding conductor 13B and a dielectric 13C therebetween) has a coupling element 13D that couples to a housing coupling element 17. A conductor 14 applies the signal from the coaxial cable 13 to the center conductor resonant element 10. However, aperture 15B is not present, the center conductor 10 secured to the housing 15 only by means of aperture 15A. The center conductor resonant element 10 is hollow (10A) and is connected (typically brazed) to a screw 32. The screw 32 has an aperture 32A formed along the screw axis, the aperture 32A permitting access to the interior 10A of the center conductor element 10. The aperture 15A of the housing 15 is threaded to accommodate the threads of screw 32. At the opposite end of the center conductor element 10 from the screw 32, the center conductor element is open and has a threaded region 10B on the interior of the element 10 in the vicinity of the opening. A locking insert 36 is positioned in the threaded region 10B and a threaded rod 35 is positioned in the locking insert 36. (The rod 35, the locking insert 36 and the center conductor element threads 10B comprise the resonator tuning apparatus). The locking insert provides friction and anti-back lash capability for rotation of the threaded rod 35. The threaded rod can be rotated by a tuning screw driver, inserted through the screw aperture 32A, extending through the interior 10A of the resonant element and engaging an appropriate structure in the interior end of threaded rod 35.

Figure 5:
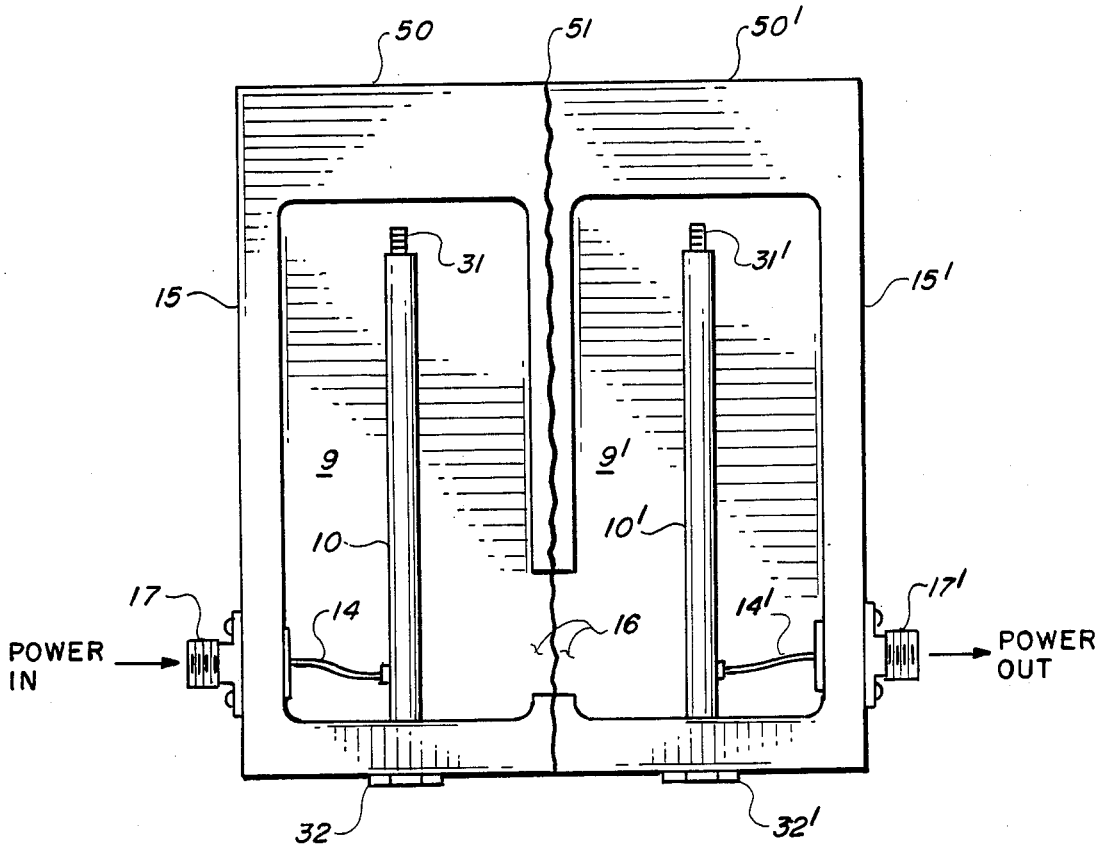
FIG. 5 is a cross sectional view of a band-pass filter using the present invention.

Referring next to FIG. 5, the use of the resonant cavity device of the present invention to implement a band-pass filter is shown. The band-pass filter includes housing 15 and housing 15' which are typically fabricated from the single piece of material. The signal into the pass band filter is applied to housing coupling device 17 and, by means of conductor 14, to center conductor resonant element 10. Center conductor element 10 has the tuning apparatus 31 coupled thereto and the center conductor element extends into the cavity 9. The signal applied to the center conductor element 10 causes the element 10 to oscillate at that frequency. The cavity structure 10, 9 and 15 oscillates efficiently only at resonance frequency. Electromagnetic fields from the cavity 9 enter cavity 9' through aperture 16. The electromagnetic fields coupled to cavity 9' by means of aperture 16 cause center conductor element 10' to oscillate at this frequency with the peak efficiently at the resonance frequency, the center conductor element 10' having tuning apparatus 31' and being located in cavity 9'. The oscillating signal of the center conductor element 10' activates conductor 14' (i.e., at the resonant frequency). The signal on conductor 14' is applied to the housing coupling element 17' and consequently becomes the band-pass filter characteristics.

2. Operation of the Preferred Embodiment

Although the resonant cavity devices of the present invention have been described in terms of the resonant frequency of the structure with center conductor element 10 (or 10'), it will be clear that the structure will pass a desired frequency spectrum, not just a single frequency. However, application of the signals to resonant cavities will narrow the envelope of the frequency spectrum. For example, FIG. 5 shows two tunable center conductor resonant elements to synchronize their resonant frequencies at the desired center frequency. Indeed, the line 51 in FIG. 5 indicates that additional resonant cavities could be inserted between the power in resonant cavity stage and the power out resonant cavity stage. The inserted resonant cavity stages are coupled to adjacent resonant cavity stages by aperture(s) 16.

Each resonant cavity stage can be tuned to the center frequency conveniently by the present invention. As indicated below, the ability to tune the resonant cavity to a predetermined frequency is more accurate than is available in the related art.

The accuracy to which the center conductor element can tune any resonant structure to a required frequency can be understood in the following manner. Assuming the center conductor element is operating in the quarter (TEM) wave mode, then the resonant frequency is given by the equation:

$$f=C/4L$$

where f is the resonant frequency, C is the velocity of light, and

L is the length of the center conductor element.

Using differential operator, DEL( ), then $$DEL(f)/DEL(L)=(approximately)-C/4L^2.$$

When the center frequency is chosen to be 1,030 MHz and the set frequency accuracy is chosen to be ABS{ DEL(F)}<0.5 MHz, where ABS { } denotes the absolute value, then the mechanical tolerances and/or backlash must be fixed to within 1.4 mil. This goal is easily achievable using the techniques of the present invention. By contrast, the tuning apparatus of the related art can have a slip (jump) in frequency of greater than 1 MHz during the tuning operation.

The capacity of the air cavity resonator device shown in FIG. 3 and FIG. 4 to handle power depends on the dielectric strength (73.6 Volts/mil for air) and the maximum voltage gradient resulting from the application of signal to the device. For a given narrow band filter, the voltage gradient is minimized at the high voltage (uncoupled) end of the center conductor element. Because the distance (labelled 2 in FIG. 4) from the free end of the center conductor resonant element to the housing can be an arbitrary amount, the voltage can be kept well below the breakdown voltage. In contrast, the air cavity resonator device of FIG. 1 and FIG. 2 typically have a relatively small distance between the end of the center conductor resonant element and the tuning element severely limits the use of the device in high power applications.

As has been mentioned previously, although the present invention is described with reference to a band-pass filter, the invention can be applied to many resonant cavity devices.

The foregoing description is included to illustrate the operation of the preferred embodiment and is not meant to limit the scope of the invention. The scope of the invention is to be limited only by the following claims. From the foregoing description, many variations will be apparent to those skilled in the art that would yet be encompassed by the spirit and scope of the invention.

What is claimed is:

1. A resonant cavity for use at microwave frequencies, said resonant cavity comprising:
- a housing having a cavity fabricated therein;
- a conductor element having a first end attached to said housing, wherein a length of said conductor element determines a resonant frequency of said cavity;
- tuning apparatus engaging threads fabricated within a second end of said conductor element, said tuning apparatus including:
  - a locking insert positioned in said threads of said second end of said conductor element; and
  - a threaded rod inserted in said locking insert, said threaded rod capable of extending beyond said conductor element second end, wherein rotation of said threaded rod controls an extension of said threaded rod beyond said conductor element second end, said extension modifying said resonant frequency; and
- activation means for applying an external signal to said conductor element.

2. The resonant cavity for use with microwave frequencies of claim 1 wherein said threaded rod is accessible to a tuning tool positioned outside of said resonant cavity.

3. The resonant cavity for use with microwave frequencies of claim 2 wherein said locking insert prevents said threaded rod from moving in an absence of an external force.

4. The resonant cavity for use at microwave frequencies of claim 3 wherein said housing includes an aperture for transmission of electromagnetic radiation therethrough.

5. The resonant cavity for use at microwave frequencies of claim 3 wherein said activation means includes a radiation source selected from the group consisting of an aperture for admitting radiation into said cavity from an adjoining cavity; and a conductor attached between said conductor element and an external signal source.

6. The resonant cavity for use at microwave frequencies of claim 4 further comprising a screw, said screw having an aperture along the axis thereof, said screw being attached to said conductor element, said screw being coupled to a threaded aperture of said housing.

7. The resonant cavity for use at microwave frequencies of claim 3 wherein said conductor element is hollow.

8. A band-pass filter for use at microwave frequencies, said band-pass filter comprising:
- a first resonant cavity device; and
- a second resonant cavity device, wherein said first and said second resonant cavity each include:
  - a housing having a cavity fabricated therein:
  - a conductor element having a first end coupled to said housing, wherein a length of said conductor element determines a cavity resonant frequency; and
  - tuning apparatus coupled to a second end of said conductor element, wherein said tuning apparatus includes a threaded member and a locking insert, said threaded member inserted in said locking insert, said locking insert minimizing movement of said threaded member in an absence of an external force, said tuning apparatus adjusting a length of said conductor element, wherein said first and said second housings have coupling apertures, said coupling apertures permit electromagnetic radiation to be transferred between said first and said second resonant cavity device housing cavities.

9. The band-pass filter of claim 8 wherein said conductor element is coupled to a cavity wall, said cavity wall and said conductor elements having aligned apertures formed therein, wherein said external force can be applied by a tool extending beyond said housing.

10. The band-pass filter for use at microwave frequencies of claim 9 further comprising at least a third resonant cavity device positioned between said first and said second resonant cavity devices, said third resonant cavity device adapted to receive electromagnetic radiation from said first resonant cavity device and adapted to transfer electromagnetic radiation to said second resonant cavity device.

11. Apparatus for adjusting a resonant frequency of a cavity structure having conducting walls, said apparatus comprising:
- a conductor element having a first end coupled to a cavity wall; and
- a conducting insert for adjusting a length of said conductor element, said conducting insert coupled to a second end of said conductor element, wherein adjusting said conductor element length adjusts said cavity structure resonant frequency, wherein said conducting insert includes:
  - a threaded member, wherein said conductor element has a threaded aperture in said second end of said conductor element;

a locking insert positioned in said conductor element threaded aperture, said threaded member being inserted in said locking insert, said locking insert preventing spontaneous rotation of said threaded member.

12. The apparatus for adjusting a resonant frequency of a cavity structure of claim 11 wherein said conductor element has a aperture passing therethrough coupled to said threaded aperture, said conducting insert being adapted to be rotated by tool passing through said conductor element.

13. The apparatus for adjusting a resonant frequency of a cavity structure of claim 12 wherein said cavity structure has an aperture formed therein, said cavity structure aperture and said conductor element structure aperture being aligned to permit said tool to pass therethrough for said conducting insert adjustment.

* * * * *

UNITED STATES PATENT AND TRADEMARK OFFICE

CERTIFICATE OF CORRECTION

PATENT NO. : 4,794,354

DATED : December 27, 1988

INVENTOR(S) : Bruce E. Dinsmore, Gary O. Larson, William H. Brettner

It is certified that error appears in the above-identified patent and that said Letters Patent is hereby corrected as shown below:

ON TITLE PAGE: Item [54] should read.

Title: APPARATUS AND METHOD FOR MODIFYING MICROWAVE FREQUENCY CHARACTERISTICS OF RESONANT CAVITIES

Signed and Sealed this

Fifteenth Day of September, 1992

*Attest:*

DOUGLAS B. COMER

*Attesting Officer*

*Acting Commissioner of Patents and Trademarks*